US006866696B1

(12) United States Patent
Naro

(10) Patent No.: US 6,866,696 B1
(45) Date of Patent: Mar. 15, 2005

(54) ADDITIVE FOR PRODUCTION OF IRONS AND STEELS

(76) Inventor: Rodney L. Naro, 19620 Edgecliff Dr., Euclid, OH (US) 44119

( * ) Notice: Subject to any disclaimer, the term of this patent is extended or adjusted under 35 U.S.C. 154(b) by 0 days.

(21) Appl. No.: 10/649,126

(22) Filed: Aug. 26, 2003

Related U.S. Application Data

(63) Continuation-in-part of application No. 10/132,637, filed on Apr. 24, 2002.

(51) Int. Cl.[7] ..... C21C 7/00; C22C 1/04

(52) U.S. Cl. ..... 75/315; 75/232; 75/316; 75/328; 75/526; 75/562

(58) Field of Search ..... 75/232, 315, 316, 75/328, 526, 562, 252

(56) References Cited

U.S. PATENT DOCUMENTS

| | | | | |
|---|---|---|---|---|
| 2,780,540 A | * | 2/1957 | Pierce | 420/87 |
| 3,421,888 A | | 1/1969 | Schelleng | |
| 3,798,027 A | | 3/1974 | Defranco et al. | |
| 4,152,150 A | * | 5/1979 | Frantzreb, Sr. | 75/303 |
| 4,390,362 A | | 6/1983 | Khusnutdinov et al. | |
| 5,008,074 A | | 4/1991 | Naro et al. | |
| 5,100,612 A | | 3/1992 | Obata et al. | |
| 5,268,141 A | | 12/1993 | Ototani et al. | |
| 6,293,988 B1 | | 9/2001 | Naro | |

OTHER PUBLICATIONS

R.L. Naro and J.F. Wallace, "Minor Elements in Gray Iron, Background for the Development of a non–Ferrosilicon based Inoculant," Report of Research Project, AFS Gray Iron Division, American Foundrymen's Society (1970).

* cited by examiner

*Primary Examiner*—Ngoclan T. Mai
(74) *Attorney, Agent, or Firm*—Renner, Otto, Boisselle & Sklar, LLP

(57) ABSTRACT

A technique for producing iron utilizes agglomerations, such as briquettes or tablets, or powders, that include a sulfur-containing material such as iron sulfide, and and oxygen containing material such as iron oxide. The agglomerations or powders are substantially free of chemical binders and utilize iron and aluminum metal powders and pressure for compaction on either roll presses or tablet machines. Addition of metal powders provides rapid dissolution of the alloy and improved heat transfer. Iron sulfide agglomerations also provide consistent and improved sulfur recoveries compared to granulated iron sulfide additions with little to no sulfur odor.

29 Claims, No Drawings

ADDITIVE FOR PRODUCTION OF IRONS AND STEELS

This application is a continuation-in-part of U.S. application Ser. No. 10/132,637, filed Apr. 24, 2002, which is herein incorporated by reference in its entirety.

BACKGROUND OF THE INVENTION

1. Technical Field of the Invention

The invention relates to production of irons and steels, and additives used in such production.

2. Description of the Related Art

The usual microstructure of gray iron is a matrix of ferrite and pearlite with graphite flakes dispersed throughout. Foundry metallurgical practices include inoculating the metal so that nucleation and growth of graphite flakes occurs in a pattern that enhances the desired mechanical properties, by addition of an inoculating. An inoculating agent can be added to either 1) the pouring ladle, 2) injecting or spraying the inoculant (in a finely divided granular or powdered form) into the metal pouring stream as the molten metals enters the mold, or as a insert placed in the mold. The amount, size and distribution of graphite are important to the physical properties of the gray iron. The use of inoculants to control microstructure as well as reduce the chilling tendency or the formation of iron carbides (or cementite) is common practice in the ferrous foundry industry. The presence of iron carbides in the iron matrix is undesirable because this constituent is hard and brittle and can result in poor mechanical properties and machinability.

In ductile irons, the usual microstructure is a matrix of ferrite and pearlite with graphite nodules dispersed throughout the structure. The size, shape and distribution of the graphite nodules is important to the physical properties of the ductile iron. Similar to gray cast iron, the nucleation and growth of the graphite nodules can be controlled by adding materials referred to as "post inoculants," to either the ladle, as an instream inoculant or as an insert placed at a strategic location in the mold. In some cases, alloy additions of silicon carbide, pure graphite and other proprietary alloy mixtures are added to molten ductile irons prior to magnesium treatment. This practice is referred to as preconditioning the molten iron.

Inoculants can best be described as elements that offer the possibility to form stable compounds with either, sulfur or oxygen, or with both. These oxy-sulfide atomic clusters provide a substrate surface with nucleation sites upon which dissolved graphite in the molten iron can start to grow as graphite flakes or nodules, before sufficient undercooling occurs that favors the formation of carbides.

Numerous metals and alloys have been proposed for use as inoculating agents in the production of both gray and ductile iron castings. Standard inoculating agents are 1) calcium silicon, 2) calcium bearing ferrosilicon alloys or other ferrosilicon based alloys that contain small percentages of oxy-sulfide forming elements and 3) finely divided and powdered synthetic graphite. The oxy-sulfide forming elements contained in inoculants are cerium and other rare earths, zirconium, calcium, aluminum, barium, strontium, magnesium and titanium. These may be referred to as "oxy-sulfide formers," individually or in selected amounts.

The effectiveness of all inoculating agents is a direct function of the amount of sulfur dissolved in the molten irons and to a lesser extent, the amount of dissolved oxygen. The ability of oxy-sulfide forming elements to form nuclei assisting substrates, i.e., oxy-sulfide atomic clusters, which in turn provides a similar crystalline surface onto which dissolved graphite atoms can precipitate from the liquid iron and grow is a necessary prerequisite for inoculation. Addition of these sulfide and oxygen compounds rejuvenates and beneficiates the molten iron and improves its responsiveness to inoculation.

It has been observed with cast irons held in a holding furnace overnight or over a weekend, insufficient oxygen and "stale" or "unreactive sulfur" levels result and as a result, these irons do not respond well to traditional inoculation methods. Sulfur and oxygen are not readily available to react with the oxy-sulfide elements to form suitable substrates for inoculation. More recently, it has been found that a joint addition of both oxygen and sulfur compounds to molten cast irons will improve the performance of cast iron inoculants. Resulfurizing cast irons with "fresh" sulfur in, conjunction with the simultaneous addition of oxygen compounds, enables improved inoculation. Fresh additions of new sulfur and oxygen allow the oxy-sulfide containing elements in inoculants to more easily form substrates for graphite precipitation.

In a few instances, intentional incorporation of sulfur and oxygen containing elements are made to the surface of ferrosilicon based inoculants. It has been claimed that the controlled additions of the elements sulfur and oxygen to commercially available ferrosilicon based inoculants can provide enhanced performance. This is an attempt to ensure that sufficient sulfur and oxygen will be available for subsequent reactions with the oxy-sulfide elements added as inoculants. However, in practice, the coating of oxygen and sulfur containing particles on the surfaces of ferrosilicon particles is not sufficiently concentrated to allow improved performance. Another drawback of incorporating inoculants which contain fine oxygen and sulfur particles coated onto larger grains of ferrosilicon inoculants is a rather unsightly product that is subject to particle segregation and coating failure and coating de-lamination. During shipping of such ferrosilicon inoculants, segregation and separation of sulfur and oxygen particles occurs, negating their final effect.

Therefore it will be appreciated that improvements in such additives would be desirable.

SUMMARY OF THE INVENTION

A technique for producing iron utilizes agglomerations, such as briquettes or tablets, includes introducing a sulfur-containing material such as iron sulfide. The agglomerations are substantially free of chemical binders and utilize iron and aluminum metal powders and pressure for compaction on either roll presses or tablet machines. Addition of metal powders provides rapid dissolution of the alloy and improved heat transfer. Iron sulfide agglomerations also provide consistent and improved sulfur recoveries compared to granulated iron sulfide additions with little to no sulfur odor.

Aspects of this invention relate to 1) the agglomeration of specific sulfur and oxygen compounds with other pure metals, in such a manner to allow their use in the fabrication of briquettes or tablets of the same sulfur-containing and oxygen-containing materials, 2) the combining and blending of specific sulfur and oxygen compounds with other selected pure metals, all materials being in granular form. The resulting composition of materials, being either agglomerations, or as a free flowing, granulated mixture, are highly useful in improving the nucleating performance of other inoculating agents commonly used in the production of gray, ductile and compacted graphite irons.

The compositions of the invention, whether an agglomeration or as a free flowing, loose, granulated mixture, when added with cast iron inoculants, improve the performance of the inoculant by adding fresh sulfur and oxygen to the molten iron. The newly added oxygen and sulfur preferentially react with oxide and sulfide forming trace elements, contained in inoculants, to form complex oxy-sulfide particles upon which graphite atoms can nucleate or form more easily and precipitate from the molten cast irons. The enhanced nucleation of graphite from molten cast irons reduces the formation of iron carbides, improves graphite shape and distribution and increases mechanical properties.

Whether used as an agglomeration or powder from, the invention increases or enhances the nucleating capability of conventional cast iron inoculants.

The agglomeration or granulated mixtures are used as a direct addition to the molten cast irons 1) in conjunction with traditional gray and ductile iron inoculants, or 2) as a "preconditioning addition" before magnesium treatment in ductile iron metallurgy.

It is one object of this invention to provide a potent, inoculant enhancing blend of sulfur, oxygen, and pure metals, which, when added with traditional inoculating agents to molten gray cast irons, causes the cementite in the cast iron to be substantially eliminated and the graphite to be evenly distributed in a beneficial manner throughout the cross section of the resultant casting. In ductile irons, the inoculant enhancing alloy mixture will also suppress cementite formation, increase nodule count and provide improved as-cast mechanical properties.

The form of the inoculant enhancing agent can be either 1) an agglomeration or specific sulfur, oxygen and selected pure metals, or 2) a granulated mixture of the same ingredients in loose or free flowing powder form.

For the manufacture of agglomerations, the product is produced on a high pressure roll briquetting press and which utilizes both soft annealed iron powder and pure aluminum powder as the primary densification agents. The iron powder provides improved specific gravity and heat transfer and the aluminum provides improved alloy dissolution. Both the iron and aluminum powders provide a source of "mechanical particle interlocking" that assists in the consolidation of the alloy ingredients into a tablet which possesses outstanding green handling properties.

The same ingredients that are used to manufacture of agglomerates may also be quite suitable for enhancing the inoculating performance of ferrosilicon based inoculants. In applications where adding agglomerations such as "briquettes or tablets" to a ladle are not practical, then the free flowing granular mixture of oxides, sulfides and metal powders can be added with the ferrosilicon based inoculants to enhance their performance, either added at the same time as the inoculant or injected into the pouring stream, again, at the same time as the primary inoculant.

These additional nucleating sites provide improved microstructures in gray cast iron which is mostly Type A graphite flakes without cementite; in ductile iron, the resultant microstructure will consist of higher nodule counts and reduced carbides.

According to an aspect of the invention, an inoculate enhancing agglomeration or loose granular powder may be made with varying blends of oxy-sulfide containing materials blended to form a mixture including about 15–30% sulfur, about 4–10% oxygen, about 45–56% iron, about 0–34% aluminum, the balance being incidental impurities and release agents.

In one particular embodiment, the inoculate enhancing agglomerate consists of essentially about 20% sulfur, about 7.6% oxygen, and about 20% aluminum, the balance being iron and incidental impurities.

In another particular embodiment, a granulated inoculant consists of about 28% silicon, about 10% oxygen, and about 7% aluminum, the balance being iron and incidental impurities.

In the chill testing of gray cast iron, chill depth was reduced by an additional 22 percent just by adding the inoculant enhancer to a commodity grade of calcium bearing 75% ferrosilicon inoculant. The ratio of 75% calcium bearing ferrosilicon to the inoculant enhancing additive was 3.27 to 1. The microstructure was characterized by a microstructure having at least 90% Type A graphite. In the case of ductile iron, the microstructure exhibited 95% nodularity, nodule count was improved by 50% and the matrix is carbide free by using a ratio of 33 to 1 inoculant enhancing additive to a blend of 75% calcium bearing ferrosilicon and an available inoculant.

According to an aspect of the invention, an agglomeration for iron and steel production, consists essentially of: a sulfur-containing material; an oxide-containing material; and a mechanical binder.

According to another aspect of the invention, an additive for iron and steel production, consists essentially of: a sulfur-metal compound; iron oxide; and a metal powder.

According to yet another aspect of the invention, an additive for iron and steel production, includes a metal-sulfur compound; a metal oxide; and a metal powder.

According to still another aspect of the invention, a method of re-sulfurizing iron, includes forming a molten base iron; and adding an additive to the base iron. The additive includes: a metal-sulfur compound; a metal oxide; and a metal powder.

To the accomplishment of the foregoing and related ends, the invention comprises the features hereinafter fully described and particularly pointed out in the claims. The following description sets forth in detail certain illustrative embodiments of the invention. These embodiments are indicative, however, of but a few of the various ways in which the principles of the invention may be employed. Other objects, advantages and novel features of the invention will become apparent from the following detailed description of the invention.

DETAILED DESCRIPTION

An iron sulfide tablet or briquette may be used to re-sulfurize molten cast irons or steels. Because soft metal binders, with high thermal conductivity are used in the tablet or briquette, dissolution is very rapid.

Agglomeration additives described in detail below are highly useful in producing cast irons with a compacted graphite (CG) structure in an effective, economical and efficient manner. The term "agglomeration," as used herein, is defined to include unitary solids, such as tablets or briquettes, in contrast to powderized or granular materials. The agglomerations are formed by combining and blending of sulfur compounds, for example iron sulfide, with mechanical binders such as metal powders, which are in turn used to fabricate high density briquettes or tablets of the same sulfur-containing combination. The fabricated agglomerations can be used as a direct addition to the molten cast irons to produce CG irons. These agglomerations (also referred to herein as "iron sulfide briquettes") may also be used as direct additions to steels for re-sulfurization, to ductile irons to revert the same iron back to gray iron, and to gray cast irons for re-sulfurization. An important use for the agglomeration additives is for the production of CG irons using a sulfur addition method.

Agglomerations such as those described below provide consistent and high recoveries of the element sulfur to molten irons. Such agglomerations advantageously dissolve immediately when added to molten irons, thereby providing consistent sulfur recoveries.

Agglomeration additives described in detail below include a sulfur-containing material and a mechanical binder. The sulfur-containing material may include metal-sulfur compound. An example of a suitable metal-sulfur compound is iron sulfide (iron pyrite).

The metal binder may include a metal powder. The metal powder may include one or more metal powders selected from the group consisting of iron powder, aluminum powder, and copper powder. An example of suitable iron powder is iron powder having a particle size distribution of −30 to +200 mesh. An example of suitable aluminum powder is aluminum powder having a particle size distribution of −20 to +200 mesh. Metal powders advantageously have a high thermal conductivity, enabling rapid dissolution of the agglomeration additive in molten iron.

Agglomerations of the present invention may be produced on a high-pressure press or roll briquette press. Iron powder may be used as the primary "carrier" and densification agent. The iron powder provides improved specific gravity and heat transfer for improved alloy dissolution. The iron powder provides a source of 'mechanical particle interlocking' that assists in the consolidation of the alloy ingredients into a tablet that possesses outstanding green handling properties. Use of iron as the "carrier" agent eliminates the need for chemical bonding agents. Aluminum granules or aluminum powder may also be used as a secondary binding agent, for example to provide another source of heat transfer which aids in dissolution or increases the melting rate of the iron sulfide briquette.

It has been found that control of final sulfur levels in CG iron production can advantageously be accomplished by adding briquetted iron pyrites to magnesium treated molten irons. The amount of sulfur that needs to be added is determined by knowing the sulfur content of the base metal as well as the residual magnesium level. The stoichiometric amount of sulfur needed to reduce magnesium to the range necessary for CG formation can then be easily calculated. Using granulated iron pyrites disadvantageously results in erratic and inconsistent sulfur recoveries since the powdered pyrites are difficult to get under the surface of the metal. Further, because of superheated convection currents, the powder may become airborne and sticks to the ladle or furnace walls and generate foul smelling sulfide gases. Iron sulfide briquettes bonded with chemical binders, either organic or inorganic, are not suitable since they do not dissociate or dissolve rapidly enough to be used in foundry melting applications, where rapid dissolution is a requirement. Iron sulfide briquettes bonded with soft metals and high pressures solve these problems and provide for consistent sulfur recoveries with little to no odor.

Although the principal use for agglomerations described herein is for the production of CG irons, they can also be used for controlled additions of sulfur to both all classes of irons as well as steels.

In the processing of ductile iron, there are certain times when it may be advantageous to re-sulfurize ductile iron for the conversion to gray iron. The sulfur contained in the briquettes combines with residual magnesium in the ductile iron. The elimination of residual magnesium converts the molten iron to normal gray iron. The conversion process of ductile to gray iron, if used, must occur very rapidly, and briquettes bonded with "matrix" or "film" chemical binders such as cement or sodium silicate will not dissolve with necessary speed required. For example, sodium silicate, a relatively inexpensive binder commonly used for certain types of ferroalloy briquettes, upon immersion into molten irons, first undergoes a transformation to a "glass phase", actually retarding the dissolution rate of the briquette, before it softens and then allows the briquette to heat up and slowly dissolve. Organic binders, such as those used for bonding sand, can also be used to bond ferroalloy briquettes. However, these binders first develop high temperature carbon or coke bonding when immersed in molten irons. This again retards the dissolution of the alloy. Ferroalloy briquettes bonded with blends of iron powder and aluminum powders or granules actually provide increased heat transfer to assist in the dissolution of the briquette.

A specific embodiment agglomeration additive is made with varying blends of iron pyrites, iron powder and aluminum powder blended to form a mixture having 30 to 40% sulfur, 1.4 to 16.0% aluminum, the balance being iron and incidental impurities. Percentages given herein are percentages by weight.

Another specific embodiment is an agglomeration additive having about 30% sulfur, about 12.35% aluminum, the balance being iron and incidental impurities.

Testing of the iron sulfide tablets or briquettes in the production of compacted graphite irons (CG iron) has shown that CG iron may form over a broader band of residual magnesium levels compared with using just magnesium wire injection in conjunction with sophisticated, computerized thermal analysis process. This method also allows for production of CG alloys without the need for titanium containing master alloys.

Production of CG irons having the composition 3.7 to 3.9% carbon, 1.8 to 2.0% silicon, 0.20 to 0.40% manganese, 0.035% residual magnesium and 0.01% sulfur can be accomplished by adding agglomerations such as those described above. Adding 0.015% sulfur as an agglomeration containing 30% sulfur, reduces the magnesium level to 0.018% with a corresponding sulfur level of 0.014%. The structure of the resulting CG iron was 80% compacted graphite with 20% nodularity. Excellent results have also been obtained used even higher base magnesium levels. In another instance, residual magnesium of the base iron was 0.045%. The addition of the stoichiometric amount of sulfur from a 30% iron sulfide briquette to a high residual magnesium base iron (0.045% magnesium), reduced the magnesium level to 0.032%, the final iron having a residual sulfur content of 0.024%. Thus using agglomerations such as those described above, high residual magnesium base irons (having magnesium levels of at least 0.040%) may be used to produce CG iron. This performance could not be accomplished by just adding iron sulfides (as iron pyrites) to an open treatment ladle. Further, the generation of large volumes of hydrogen sulfide and other sulfurous gases may be avoided by using agglomerations such as those described above.

Oxide-Containing Additives

An agglomeration or alloy mixture containing sulfides and oxides with pure metals may be used to improve the inoculating capability of cast iron inoculants. Because soft metal binders, with high thermal conductivity are used in the tablet or briquette, dissolution is very rapid. The agglomeration contains additional, fresh sulfur and oxygen to effectively and significantly improve the inoculating ability of cast iron inoculants. The same blend of ingredients used for tablet fabrication, but with different iron and aluminum levels, may also be used in the granular form for inoculation improvement.

Agglomeration additives described in detail below include a sulfur-containing material, an oxygen-containing material, and a mechanical binder or pure metal. The sulfur-containing material may include metal-sulfur compound. An example of a suitable metal-sulfur compound is iron sulfide (iron pyrite). The oxygen-containing material may include a metal-oxide compound. An example of a suitable metal-oxide is iron oxide (mill scale).

A specific embodiment agglomeration additive is made with varying blends of iron pyrites, mill scale, iron powder, and aluminum powder to form a mixture having about 20 to 40% sulfur, about 0 to 16.0% aluminum, and about 1.5 to 10% oxygen, the balance being iron and incidental impurities. Percentages given herein are percentages by weight.

In another embodiment, an inoculate enhancing agglomeration or loose granular powder may be made with varying blends of oxy-sulfide containing materials blended to form a mixture including about 15–30% sulfur, about 4–10% oxygen, about 45–56% iron, about 0–34% aluminum, the balance being incidental impurities and release agents.

In one particular embodiment, the inoculate enhancing agglomerate consists of essentially about 20% sulfur, about 7.6% oxygen, and about 20% aluminum, the balance being iron and incidental impurities.

In another particular embodiment, a granulated inoculant consists of about 28% silicon, about 10% oxygen, and about 7% aluminum, the balance being iron and incidental impurities.

Testing of the inoculant enhancing alloy was conducted with a high carbon, Class 30 gray iron made from virgin charge materials. The test heats were prepared in a 450 pound high frequency induction furnace. ASTM A367-60 W-3 chill wedges were poured to assess the extent of carbide formation. The composition of the gray iron was 3.33% carbon, 2.52% silicon, 0.341% manganese, 0.0342% sulfur, and 0.03% phosphorous, and resulted in a carbon equivalent of 4.17.

The following inoculants were evaluated: 1) a foundry grade calcium bearing 75% ferrosilicon and 2) an oxy-sulfide containing inoculant (Inoculant A). The Inoculants A & B discussed herein may be obtained from Elkem ASA, of Norway, as well as possibly from other suppliers. Each inoculant was tested as the sole addition and then with an addition of the inoculant enhancer (IE). The analysis of the inoculants is shown in Table 1.

TABLE 1

Composition of Inoculants used for testing

| Inoculant | Si | Ca | Al | Cr | O | S | Fe |
|---|---|---|---|---|---|---|---|
| 75% FeSi | 74.9% | 0.94% | 1.19% | — | — | — | Balance |
| Inoculant A | 71.8% | 0.98% | 0.97% | 1.7% | <1.0% | <1.0% | Balance |

Results of the chill tests are shown in Table 2:

TABLE 2

Effect of Inoculant Enhancing Alloy on Inoculant Chill Reduction

| Inoculant | % Addition | Chill depth, mm | % Chill Redctn. |
|---|---|---|---|
| None - Base iron | — | 5.7 | — |
| 75% Ferrosilicon | 0.40% of metal wt. | 3.1 | 43.8% |
| 75% Ferrosilicon plus Inoculant Enhancer | 0.40% of metal wt. 0.12% of metal wt. | 1.9 | 66.6% |
| Inoculant A | 0.20% of metal wt. | 2.5 | 56.1% |
| Inoculant A plus Inoculant Enhancer | 0.20% of metal wt. 0.12% of metal wt. | 1.9 | 66.6% |

As shown in Table 2, the addition of calcium bearing foundry grade 75% ferrosilicon was effective in reducing chill depth. The base chill sample taken from the furnace and not inoculated provided 5.7 mm of clear chill. The addition of 75% ferrosilicon reduced the chill by 43.8% to 3.1 mm compared to the untreated, uninoculated base iron chill. An addition of the inoculant-enhancing alloy of 0.12% by weight of the metal produced even greater chill reduction of 66.6% compared to the base furnace chill, or 1.9 mm of clear chill. The performance of the commodity grade 75% Foundry ferrosilicon was significantly improved by the small addition of the sulfur and oxygen-containing alloy.

Similar results are shown for the inoculant alloy (Inoculant A). Since such inoculants are more potent than foundry grade 75% ferrosilicon, reduced amounts are typically used. The addition of 0.20% of Inoculant A provided a 56.1% chill reduction from the base, untreated furnace chill to 2.5 mm. Adding 0.12% by weight of the inoculant enhancing alloy again provided an even further chill reduction to 1.9 mm. The chill reduction capability of the commodity grade 75% ferrosilicon with the inoculant enhancing alloy addition provides greater chill reduction capability than Inoculant A alone. The performance of Inoculant A is also improved by the addition of the inoculant-enhancing alloy.

In testing with ductile irons, using inoculant enhancing agglomerated alloy, along with a mixture of a commodity foundry grade 75% ferrosilicon and a barium-containing inoculant (Inoculant B), significant increases in graphite nodule formation resulted. The analysis of the inoculants used in this study is shown in Table 3.

TABLE 3

Analysis of Inoculants used with the Inoculant Enhancing Alloy

| Inoculant Type | Si | Ca | Al | Ba | Mn | Fe |
|---|---|---|---|---|---|---|
| 75% Ferrosilicon | 75.3% | 1.05% | 1.10% | — | — | Balance |
| Inoculant B | 62.3% | 1.85% | 1.3% | 5.1% | 9.5% | Balance |

These results are shown in Table 4:

TABLE 4

Effect of Inoculant Enhancing Alloy on Mechanical Properties and Nodule Count

| Inoculant | Amount added | Nod. count (Nod./mm$^2$) | Tensile Strength | Yield Strength | Elongat'n |
|---|---|---|---|---|---|
| Foundry 75% FeSi | 0.46% | 200–225 | 80,000 psi | 55,000 psi | 6.0% |
| Inoculant B | 0.20% | | | | |

TABLE 4-continued

Effect of Inoculant Enhancing Alloy on Mechanical Properties and Nodule Count

| Inoculant | Amount added | Nod. count (Nod./mm$^2$) | Tensile Strength | Yield Strength | Elongat'n |
|---|---|---|---|---|---|
| Foundry 75% FeSi | 0.40% | 300–350 | 85,000 psi | 59,000 psi | 13.0% |
| Inoculant B | 0.20% | | | | |
| Inoculant Enhancing Alloy | 0.018% | | | | |

The results of the field trials showed that the by incorporating a small amount of the inoculant enhancing inoculant agglomerate, nodule counts were significantly improved. The nodules that formed were smaller and more rounded. The mechanical properties of the ductile irons were also significantly improved by the addition of 0.018% inoculant enhancing alloy. In particular, the percent elongation increased by 116%. The amount of inoculant-enhancing alloy added may be from about 10 to 40% of the total weight of the inoculant plus the inoculant-enhancing alloy.

Although the invention has been shown and described with respect to a certain embodiment or embodiments, it is obvious that equivalent alterations and modifications will occur to others skilled in the art upon the reading and understanding of this specification. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An agglomeration for iron and steel production, consisting essentially of:

a sulfur-containing material;

an oxide-containing material; and a mechanical binder.

2. The agglomeration of claim 1, wherein the mechanical binder includes a metal powder.

3. The agglomeration of claim 1, wherein the mechanical binder includes one or more metal powders selected from the group consisting of iron powder, aluminum powder, and copper powder.

4. The agglomeration of claim 1, wherein the mechanical binder includes both iron powder and aluminum powder.

5. The agglomeration of claim 4, wherein the agglomeration includes at least about 15% by weight sulfur, at least about 4% by weight oxygen, and at least about 1% by weight aluminum, the balance being iron and incidental impurities.

6. The agglomeration of claim 5, wherein the agglomeration includes no more than about 30% by weight sulfur, no more than about 10% by weight oxygen, and no more than about 34% weight aluminum.

7. The agglomeration of claim 1, wherein sulfur-containing material includes a sulfur-metal compound.

8. The agglomeration of claim 1, wherein the sulfur-containing material includes iron sulfide.

9. An additive for iron and steel production, consisting essentially of:

a sulfur-metal compound;

iron oxide; and an elemental a metal powder.

10. The maternal of claim 9, wherein the additive is in the form of an agglomeration.

11. The material of claim 9, wherein the sulfur-metal compound includes iron sulfide.

12. The material of claim 11, wherein the metal powder includes iron powder.

13. The material of claim 12, wherein the metal powder includes aluminum powder.

14. The material of claim 13, wherein the material is in the form of a granular powder.

15. An additive for iron and steel production, comprising:

a metal-sulfur compound;

a metal oxide; and an elemental metal powder.

16. The additive of claim 15, wherein the metal-sulfur compound includes iron sulfide.

17. The additive of claim 15, wherein the metal powder includes one or more metal powders selected from the group consisting of iron powder, aluminum powder, and copper powder.

18. The additive of claim 15, wherein the metal powder includes iron powder.

19. The additive of claim 18, wherein the metal powder also includes aluminum powder.

20. The additive of claim 19, wherein the metal-sulfur compound includes iron sulfide.

21. The additive of claim 20, wherein the metal oxide includes iron oxide.

22. The additive of claim 15, wherein the additive is in the form of a powder.

23. The additive of claim 15, wherein the additive is in the form of an agglomeration.

24. A method of re-sulfurizing iron, comprising:

forming a molten base iron; and adding an additive to the base iron;

wherein the additive includes:

a metal-sulfur compound;

a metal oxide; and an elemental metal powder.

25. The method of claim 24, wherein the additive is in the form of an agglomeration.

26. The method of claim 24, wherein the additive is in the form of a powder.

27. The method of claim 24, further comprising adding an inoculant to the iron.

28. The method of claim 27, wherein the adding the additive and the adding the inoculant occur substantially simultaneously.

29. The method of claim 27, wherein the weight of the additive added is from about 10 to 40% of the total weight of the inoculant and the additive.

* * * * *